US005190444A

United States Patent [19]

Grinsteiner et al.

[11] Patent Number: 5,190,444

[45] Date of Patent: Mar. 2, 1993

[54] TANDEM FUEL PUMP ASSEMBLY FOR INTERNAL COMBUSTION ENGINE

[75] Inventors: James J. Grinsteiner, Union; David B. Meisner, Carol Stream, both of Ill.

[73] Assignee: Navistar International Transportation Corp., Chicago, Ill.

[21] Appl. No.: 748,121

[22] Filed: Aug. 21, 1991

[51] Int. Cl.[5] ..... F04B 23/08

[52] U.S. Cl. ..... 417/199.1; 417/254

[58] Field of Search ..... 417/199.1, 205, 244, 417/254

[56] References Cited

U.S. PATENT DOCUMENTS

| | | | |
|---|---|---|---|
| 2,413,851 | 1/1947 | Taylor | 417/199.1 |
| 2,804,018 | 8/1957 | Ryder et al. | 417/199.1 |
| 4,546,745 | 10/1985 | Brotherston | 417/199.1 |
| 4,699,572 | 10/1985 | Balkau et al. | 417/254 |

OTHER PUBLICATIONS

Piston Pump manufactured by A-C Rochester Division of General Motors Corp. under part No. 93151920.

FP-13 Piston Pump made by the Automotive Group of Robert Bosch Corp.

Navistar drawing 1801425C2 is a diaphragm pump made by Carter Automotive Company (MS60278S).

*Primary Examiner*—Richard A. Bertsch
*Assistant Examiner*—Alfred Basichas
*Attorney, Agent, or Firm*—Dennis K. Sullivan

[57] ABSTRACT

A tandem fuel pump assembly for internal combustion engines includes a housing having a fixed spring retainer mounted thereinside which supports a diaphragm pump biassing spring thereabove to force a diaphragm defining the movable lower wall of a first pumping chamber to reduce the volume thereof and eject fuel from an outlet thereof preferably through a fuel filter to the inlet of a second piston pumping chamber. A second biassing spring supported below the spring retainer forces a pumping piston downwardly to reduce the volume of the second pumping chamber and thereby eject fuel therefrom to an engine fuel rail for injection into the engine therefrom. The diaphragm and piston are mechanically connected by a pump stem through a lost motion connection to accommodate differing pumping strokes of the two pumps, so that a single tappet actuated by the engine camshaft mechanically raises the piston to cause movement thereof to fill the second piston pump chamber while the biassing spring of the piston pump pulls the diaphragm through the stem against the action of its biasing spring to fill the first chamber during the pumping stroke of the piston pump.

19 Claims, 2 Drawing Sheets

TANDEM FUEL PUMP ASSEMBLY FOR INTERNAL COMBUSTION ENGINE

BACKGROUND OF THE INVENTION

The present invention relates to a fuel pumping apparatus for a fuel-injected internal combustion engine, especially a diesel engine, and more particularly, to a tandem fuel supply pump assembly incorporating two interconnected pumps—a diaphragm pump and a piston pump, both driven by a single tappet which is actuated by an eccentric on the camshaft of the associated engine.

THE PRIOR ART

Heretofore, various fuel pump assemblies for use in fuel injected engines have been used to supply fuel to a fuel injection pump or to a common fuel rail supplying a plurality of unit injectors. Typically, such fuel pump assemblies may include a single piston pump therein and a hand priming piston pump, since piston pumps are known to be poor at priming while they operate well under high pressure.

Diaphragm pumps, on the other hand, are not typically used in this environment because, although they are operationally preferred for priming under low pressure, they do not accommodate a high pressure environment well.

SUMMARY OF THE INVENTION

Accordingly, it is a primary object of the invention described and claimed herein to provide a pump assembly for supplying high pressure fuel to be used in a fuel rail of a fuel-injected internal combustion engine which combines both types of pumps therein in tandem, thereby providing good priming and operational efficiency at high pressures in a compact economical apparatus.

According to the invention, there is provided a tandem fuel pump assembly for an internal combustion engine incorporating therein two pumps in tandem—a piston pump and a diaphragm pump. The pumping members of the two pumps are interconnected through a lost motion connection so that both pumps are operated by a single tappet which is actuated by an eccentric on the camshaft of the engine while the pumping strokes of the pumps may vary. The pumps are fluidly connected, preferably through a fuel filter, so that the input of the piston pump is fed by the output of the diaphragm pump.

More particularly, the tandem pump assembly includes a housing having a fixed spring retainer mounted thereinside which supports a diaphragm pump biassing spring thereabove to force a diaphragm defining the movable lower wall of a first pumping chamber to reduce the volume thereof and eject fuel from an outlet thereof to said fuel filter. A second biassing spring supported below the spring retainer forces a pumping piston downwardly to reduce the volume of a second pumping chamber and thereby eject fuel therefrom to an engine fuel rail for injection into the engine therefrom. The diaphragm and piston are mechanically connected by a pump stem through a lost motion connection to accommodate differing pumping strokes of the two pumps, so that a single tappet actuated by the engine camshaft mechanically raises the piston to cause movement thereof to fill the second piston pump chamber .While the biassing spring of the piston pump pulls the diaphragm through the stem against the action of its biasing spring to fill the first chamber during the pumping stroke of the piston pump.

BRIEF DESCRIPTION OF THE DRAWINGS

Other objects and advantages of the invention will become more apparent upon perusal of the detailed description thereof and upon inspection of the drawings in which.

DESCRIPTION OF THE PREFERRED EMBODIMENT

Figure 1:
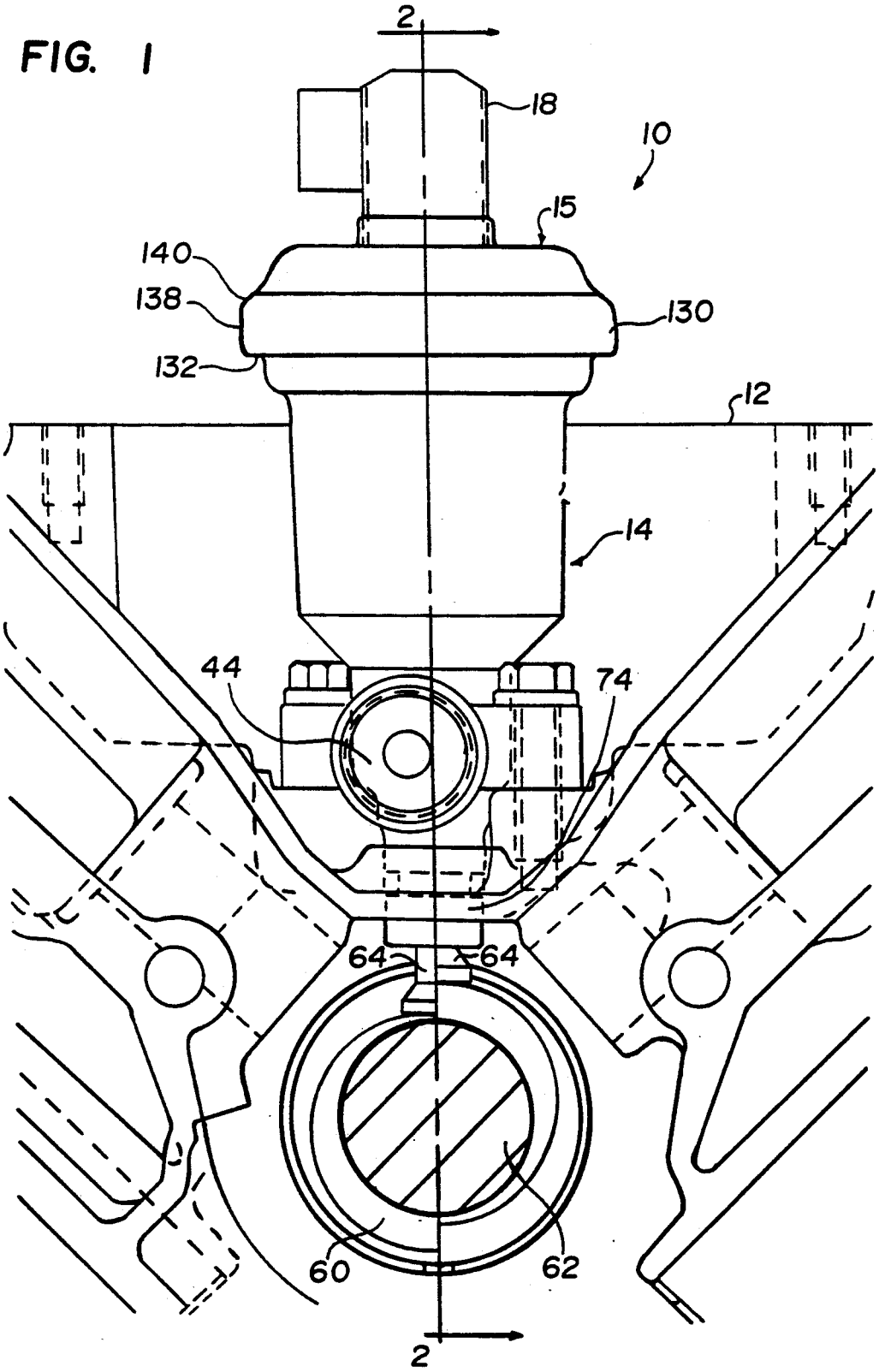
FIG. 1 is a transverse cross section of a portion of an internal combustion engine in which the tandem fuel pump assembly of the invention is mounted.

Referring now to the drawings in greater detail, there is illustrated therein a tandem fuel pump assembly 10 made in accordance with the teachings of the present invention which is mounted within the V of a fuel-injected internal combustion engine 12 preferably but not necessarily a diesel engine. As shown, the assembly 10 includes a cylindrical housing comprising a main body 14 and a cap 15 therefor, the cap being topped by two valve towers 16 and 18.

Figure 2:
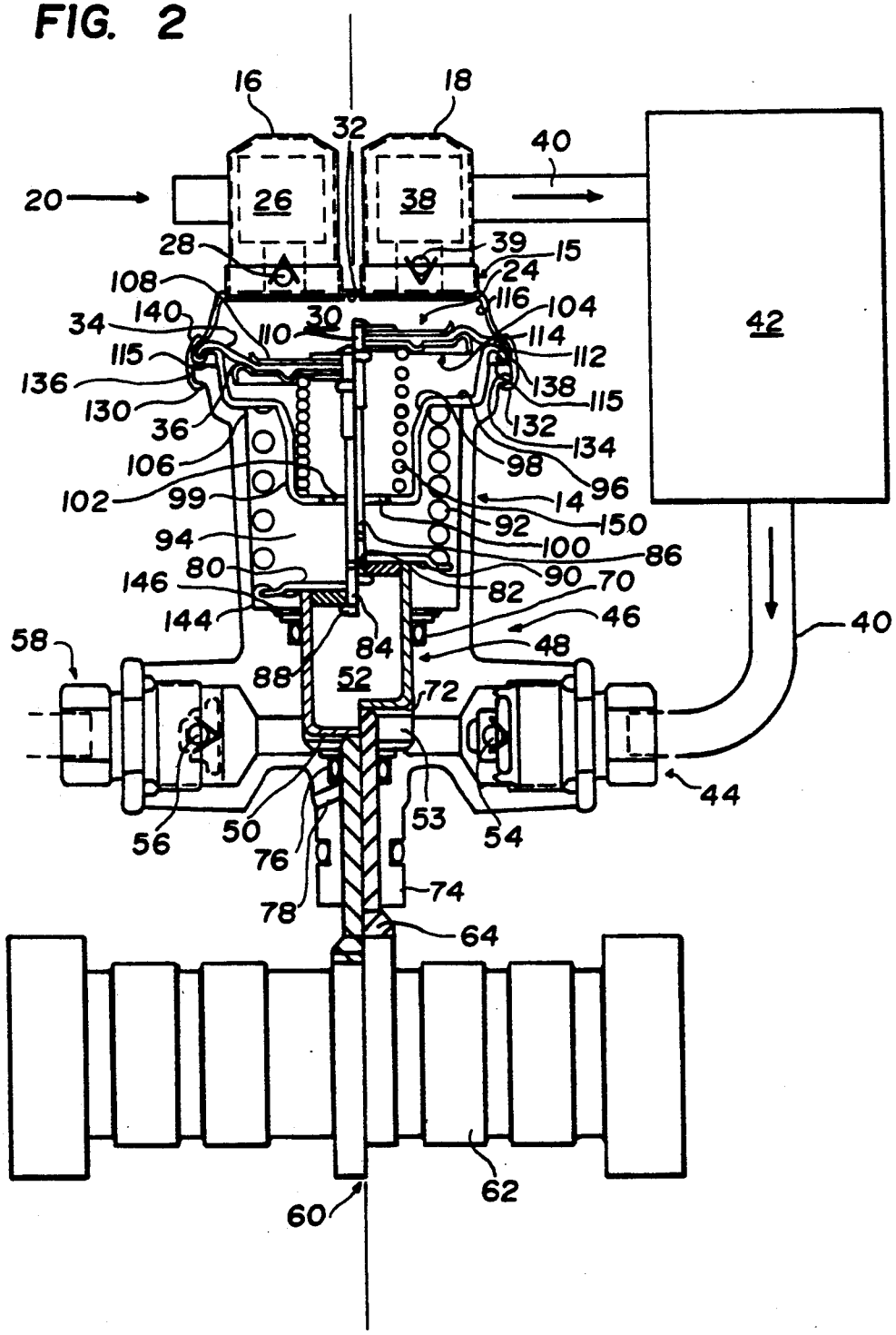
FIG. 2 is a functionally split cross-section through the tandem fuel pump assembly of FIG. 1, taken along the line 2—2 thereof, together with a schematic illustration of the fluid path and a portion of the camshaft of an internal combustion engine in which the pump assembly would be installed, the left side of the Figure showing the pumping elements in a lowermost position thereof and the right side of the Figure showing the pumping elements elevated.

As best seen in FIG. 2, the towers 16 and 18 form a fuel inlet 20 and outlet 58 for a fuel pathway through a first pumping chamber 30 of the assembly 10 within the cap 15, the pumping chamber having a movable wall defined by a diaphragm assembly 24. In this respect, fuel enters the valve tower 16 from a source thereof such as a vehicle fuel tank (not shown) and flows through a passage 26 incorporating a check valve 28 therein to prevent reverse flow from the pump chamber 30 formed between an upper surface 32 of the housing cap 15 and an upper surface 34 of a diaphragm 36 of the diaphragm pump assembly 24.

Upon upward motion of the diaphragm assembly 24 within the housing 14, the one way check valve 28 prevents reverse flow of fuel back into the tower 16 and the fuel is forced into a passage 38 in the exit tower 18. Within the passage 38 is provided another check valve 39 to prevent fuel from flowing back into the pump chamber 30 on the fill stroke.

From the second tower 18 the fuel is passed through a fuel line 40 preferably including a fuel filter 42 therein and then is fed to a second pathway 44 through a lower section 46 of the housing 14 which includes a piston pump 48 therein. A lower end 50 of a piston 52 is slidingly mounted within a cylindrical bore 72 in the lower part of the housing 14 and extends within a central chamber 53 in the second pathway 44 when the piston 52 is in its lowermost position shown on the left side of the drawing. A double lip seal 70 is disposed in the bore 72 and operates against the piston 52 to prevent fuel leakage past the piston. The second pathway 44 also includes check valves 54, 56 at each end thereof and suitably disposed to ensure a single direction of fuel flow therethrough.

The piston 52 is coupled to an eccentric 60 on a camshaft 62 of the engine 12 by a tappet 64 disposed between the eccentric 60 and the lower end 50 of the piston 52. Under influence of the eccentric 60, the tappet 64 raises the piston 52 in the bore 72 and draws fuel into the chamber 53 for subsequent pumping out of an outlet 58 in the housing 14. Fuel under relatively high pressure, e.g. 80 psi, leaves from outlet 58 of the tandem pump assembly and is fed to the fuel rail injection system (not shown) of the vehicle engine 12. It should be understood that the tandem fuel supply pump of the invention also could be used to feed fuel to a conventional fuel injection pump mounted externally on the engine.

The housing 14 further includes a lower neck portion 74 within which the tappet 64 is slidably received and which is mounted a bore in the crankcase of engine 12 to properly locate the pump assembly 10 relative to the camshaft 62 as shown in FIG. 1. Although a double lip seal 76 has been provided in the neck portion 74 around the periphery of the tappet 64 to keep any fuel from leaking around the tappet 64, if a leak occurs in this area, a weep hole 78 is provided in the housing 14 to vent such leakage to ambient.

The piston 52 is hollow and receives at its upper end a locating spacer 80 having a central throughbore 82 therein within which a lower end 84 of a diaphragm stem 86 is secured by an interference fit. The stem 86 includes a stop member 88 at the lower end 84 thereof which provides additional assurance that the end 84 of the stem 86 will not disengage from the throughbore 82.

To accommodate variations in the stroke of the diaphragm pump relative to the piston pump, the locating spacer 80 slides downwardly within the piston 52 away from a circular lower spring seat 90 biassed against the upper edge of piston 52 by the lower end of a piston biassing spring 92 seated thereupon within a cavity 94 of the housing 14. The upper end of the piston biassing spring 92 seats against the lower side of a radial surface 96 of a recessed spring retainer 98 fixed within the chamber 94 and extending thereacross. The central portion 99 of the spring retainer 98 is offset from the outer radial portion thereof to form a central recess having a lower flanged edge 100 disposed about a central opening 102 therein through which the diaphragm stem 86 extends.

The diaphragm stem 86 engages a diaphragm support 104 disposed above the spring retainer element 98 and including a lower flange 106 seated against one surface of the diaphragm 36 and an upper flange 108 seated against the other surface of the diaphragm 36. The flanges 106 and 108 extend from and are fixedly engaged to a top portion 110 of the diaphragm stem 86.

The recessed spring retainer element 98 has a peripheral edge portion 112 which is downwardly stepped in an outwardly radial direction to conform to a stepped configuration provided in the pump housing 14 in the area of engagement. A peripheral edge 114 of the diaphragm 36 is captured by an inwardly rolled edge 115 of inner surface 116 of the housing cap 15 which extends around the entire circumference of the pump chamber 30 so that that the chamber 30 is sealed. The upper housing cap 15 and the spring retainer element 98 therebelow are clamped to the lower housing section 14 by a circumferential band 130. In this respect, the band 130 has a lower planar lip 132 thereof engaging against a bottom surface 134 of a radially outwardly stepped top flange 136 of the lower section 14. The band 130 then turns upwardly into a vertical portion 138 which in turn leads into a radially upwardly and inwardly directed flange 140 configured to conform to the shape of the housing cap 15 in the area of engagement.

The housing 14 further includes a second port 144 therein at a location approximately aligning with a bottom surface 146 of the internal cavity 94 and extending downwardly therefrom through the housing 14. This port 144 is provided to allow any fuel which might leak past the diaphragm 36 or piston seal 70 to exit from the assembly 10 into the area and additionally provides and air vent to permit unrestricted movement of the diaphragm assembly 24 within the cavity 94.

As described above, the spring retainer 98 is a stationary element above which is supported a second biassing spring 150 of relatively small dimension and spring rate, compared to the piston spring 92. The spring 150 engages the lower side of the flange 106 of the diaphragm support 104 and, because of its smaller diameter, seats against the lower flanged edge 100 of the spring retainer 98, close to and around the central opening 102 therein.

In operation of the tandem pump assembly 10, at engine start up, the diaphragm pump assembly 24 initially makes full strokes for purposes of filling the system with fuel. Subsequently, after priming is completed, only short strokes are required to supply sufficient fuel for the piston pump 48 to satisfy engine requirements. In this respect, due to the relatively large diameter of the diaphragm 36, a very large volume of fuel can be moved into the diaphragm pump chamber 30 via the entry tower 16 and out of the chamber 30 through the exit tower 18 on a full stroke of the diaphragm 36. Once the system is primed, because of the volume differential between the size of the diaphragm pump chamber 30 and the amount of fuel that can be accommodated in the piston pump chamber 53, only very small movement of the diaphragm 36 is required, somewhere on the order of 0.06 inch. The piston 52 on the other hand, because of its smaller area, moves somewhere in the range of 0.25 inch during each stroke.

The pressure in the chamber 30 above the diaphragm 36 is created by the force of the second biassing spring 150 acting on the diaphragm 36 and is on the order of about 5 psi. The large biassing spring 92 acting against the piston creates a pressure up to 80 psi on the fuel within the piston pump chamber 53 and causing ejection of the fuel out of the tandem pump assembly 10 and into the engine fuel rail.

The eccentric 60 on the camshaft 62 causes upward motion of the piston 52, via tappet 64, against the spring 92. As the piston 52 moves to its most elevated position, as shown on the right side of FIG. 2, the lower end 84 of the diaphragm stem 86 is pulled upwardly by spring 150 which in turn raises the diaphragm 36 at the upper end 110 of the stem 86 evacuating the chamber 30 while filling the piston pump chamber 53 with fuel.

Next, when the eccentric 60 is rotated 180 degrees on the camshaft 62, the tappet 64 and piston 52 are moved downwardly under action of spring 92, thereby evacuating the piston chamber 53 and forcing fuel from the exit 58 to the engine fuel rail. The downward motion of the piston 52 inherently causes downward motion of the diaphragm stem 86 and the diaphragm 36 against action of the spring 150, thus causing filling of the chamber 30 through inlet 20. In this connection, it will be noted that the force exerted by the spring 92 must overpower the opposite force exerted by the spring 150 for the pump assembly 10 to operate.

An important aspect of the invention is that the connection of the diaphragm stem 86 to the piston 52 is by a lost motion connection allowing the spacer 80 to move downwardly within the piston 52 to accommodate the shorter stroke of the diaphragm 36 relative to the piston during normal operation while permitting a larger diaphragm stroke during priming. The stroke of the diaphragm pump 24 is self-limited by the volume of fuel required while the stroke of the piston pump 48 is fixed by the eccentric 60. Thus, when the diaphragm 36 reaches the end of its stroke, the piston 52 is permitted by the lost motion connection to continue to move upwardly to complete its stroke without interference.

Thus, there has been provided, in accordance with the invention a tandem fuel pump assembly for an internal combustion engine which fully satisfies the objects, aims and advantages set forth above. It is recognized that others may develop variations, alternatives and modifications of the invention after a perusal of the foregoing specification. Accordingly, it is intended to cover all such variations, modifications, and alternatives as may fall within the scope of the appended claims.

What is claimed is:

1. A tandem fuel pump assembly for an internal combustion engine comprising:

a housing having a cavity which accommodates two pumping elements therein, said housing including a first fuel pathway therethrough including a first chamber having an inlet thereto from a source of fuel and a pumping outlet therefrom, and a second fuel pathway therethrough including a second chamber having an inlet thereto and an outlet therefrom adapted to feed an engine injection system, said pumping outlet from said first chamber feeding pressurized fuel to said inlet to said second chamber;

a first movable pumping element disposed in said housing and partially defining said first chamber for filling and evacuating said first chamber;

a second movable pumping element disposed in said housing and partially defining said second chamber for filling and evacuating said second chamber, said first and second pumping elements being biased by first and second springs disposed within said housing respectively between each pumping element and said housing, said first and second pumping elements being mechanically connected to one another through a lost motion connection permitting said first pumping element to have a shorter stroke than the stroke of said second pumping element; and actuating means for operating said second pumping element to cause operation of both pumping elements against the action of said biasing springs.

2. The invention in accordance with claim 1 wherein said actuating means comprises a single tappet adapted for movement by an engine camshaft eccentric, said tappet being mechanically engaged with said second pumping element.

3. The invention in accordance with claim 1 wherein the inlets and the outlets respectively to both said first chamber and said second chamber include check valves therein appropriately disposed to create a single direction of fuel flow.

4. The invention in accordance with claim 3 wherein said first pumping element comprises a diaphragm.

5. The invention in accordance with claim 4 wherein said second pumping element comprises a piston.

6. The invention in accordance with claim 5 wherein said actuating means comprises a tappet operatively disposed for movement by an eccentric on an engine camshaft.

7. The invention in accordance with claim 6 wherein said tappet forces said piston upwardly against said second biasing spring.

8. The invention in accordance with claim 7 wherein said piston is maintained in its lowermost position by said second biasing spring acting thereon through a spring seat means.

9. The invention in accordance with claim 8 wherein said spring seat means is operatively engaged to a lower portion of a diaphragm valve stem by a lost motion connection limiting upward movement of said stem relative to said seat means while permitting upward movement of said seat means and piston relative to said stem.

10. The invention in accordance with claim 9 wherein said seat means comprises a circular disk having a central aperture and a spring contacting peripheral edge portion and said stem comprises a locating spacer thereon disposed below said disk for abutment therewith, said spacer extending into a hollow inner periphery of said piston.

11. The invention in accordance with claim 10 wherein said valve stem fixedly engages the diaphragm of the diaphragm pump at the upper end of the stem.

12. The invention in accordance with claim 11 wherein said diaphragm is upwardly biased by said first biasing spring situated therebeneath.

13. The invention in accordance with claim 1 and said housing including a spring retainer disposed in fixed position therein between said pumping elements, each of said springs engaging opposite surfaces of said spring retainer.

14. The invention in accordance with claim 13 including a port in said housing exiting from said cavity.

15. The invention in accordance with claim 14 wherein said housing comprises an upper section and a lower section which are joined together by a circumferential band which engages the sections together.

16. The invention in accordance with claim 15 including a fuel filter disposed between the outlet from the first pathway and the inlet to the second pathway.

17. A tandem fuel pump assembly for an internal combustion engine including a diaphragm pump having a diaphragm mechanically engaged with a piston of a piston pump through a lost motion connection, said diaphragm and said piston being spring biased and both operated against the force of the springs by a single tappet disposed to engage a bottom surface of the piston and adapted to be operated by an eccentric on said engine, said diaphragm pump being disposed to feed fuel at the output pressure thereof to said piston pump which operates to eject fuel under high pressure for use in an injection system of the engine.

18. A tandem fuel pump assembly for an internal combustion engine comprising:

a housing defining a cavity therein, said housing including a fixed spring retainer centrally disposed in said cavity to provide radially disposed spring retaining surfaces on both sides thereof, said housing further partially defining a first pumping chamber adjacent an upper portion of said cavity and having a fuel inlet and a fuel outlet fluidly connected to said first chamber, and a second pumping chamber adjacent a lower portion of said cavity and a second fuel inlet and a second fuel outlet fluidly connected with said second chamber;

check valve means suitably disposed in said fuel inlets and outlets to provide unidirectional flow from said chamber inlets to said chamber outlets; a diaphragm disposed within said housing cavity above said spring retainer to sealingly enclose said first pumping chamber;

a diaphragm spring disposed between said diaphragm and said spring retainer, said diaphragm spring biasing said diaphragm to reduce the volume of said first pumping chamber;

a piston disposed within said housing cavity below said spring retainer to sealingly enclose said second pumping chamber;

a piston spring disposed between said piston and said spring retainer, said piston spring biasing said piston to reduce the volume of said second pumping chamber, said piston spring having a substantially greater spring rate than the spring rate of said diaphragm spring;

means interconnecting said piston and said diaphragm, said interconnecting means providing a lost motion connection therebetween permitting said piston to move upwardly relative to said diaphragm while preventing said piston from moving downwardly relative to said diaphragm beyond the limits of said lost motion connection; and mechanical actuating means operatively disposed to move said piston against said piston spring to fill said second chamber while permitting said diaphragm spring to pump fuel from said first chamber to said second chamber, said piston spring, upon release of said actuating means, being disposed to cause said piston to pump fuel from said second chamber while pulling said diaphragm against the force of said first spring to cause said first chamber to fill.

19. The invention in accordance with claim 18 and said mechanical actuating means comprising a tappet adapted to engage an eccentric disposed on an engine.

* * * * *